US011261733B2

(12) United States Patent
Evirgen et al.

(10) Patent No.: US 11,261,733 B2
(45) Date of Patent: Mar. 1, 2022

(54) FOUR-STROKE ROTARY- PISTON ENGINE WITH ADJUSTABLE COMPRESSION RATIO AND ADJUSTABLE VALVE CONTROL TIMES

(71) Applicants: Bülent Pulat Evirgen, Vienna (AT); Bilge Dreysel, Neumünster (DE)

(72) Inventors: Bülent Pulat Evirgen, Vienna (AT); Bilge Dreysel, Neumünster (DE)

( * ) Notice: Subject to any disclaimer, the term of this patent is extended or adjusted under 35 U.S.C. 154(b) by 166 days.

(21) Appl. No.: 15/768,713

(22) PCT Filed: Oct. 16, 2015

(86) PCT No.: PCT/EP2015/073980

§ 371 (c)(1),
(2) Date: Apr. 16, 2018

(87) PCT Pub. No.: WO2017/063710

PCT Pub. Date: Apr. 20, 2017

(65) Prior Publication Data

US 2018/0306033 A1 Oct. 25, 2018

(51) Int. Cl.

| | |
|---|---|
| ***F01B 13/04*** | (2006.01) |
| ***F01B 5/00*** | (2006.01) |
| ***F02B 75/26*** | (2006.01) |
| ***F02B 57/06*** | (2006.01) |
| ***F01C 20/14*** | (2006.01) |
| ***F01L 7/02*** | (2006.01) |
| ***F02B 57/04*** | (2006.01) |

(52) U.S. Cl.
CPC ..... *F01B 13/045* (2013.01); *F01B 5/00* (2013.01); *F01C 20/14* (2013.01); *F01L 7/026* (2013.01);

(Continued)

(58) Field of Classification Search
CPC .. F01B 13/045; F01B 5/00; F01B 1/06; F01B 1/0624; F01B 1/0686; F01B 1/0675;
(Continued)

(56) References Cited

U.S. PATENT DOCUMENTS

| | | | |
|---|---|---|---|
| 1,040,716 | A | 10/1912 | Manrodt |
| 1,285,835 | A | 11/1918 | Sunderman |

(Continued)

FOREIGN PATENT DOCUMENTS

| | | | |
|---|---|---|---|
| CH | 376317 | A | 3/1964 |
| DE | 2610869 | A1 | 9/1977 |

(Continued)

OTHER PUBLICATIONS

International Search Report for corresponding PCT/EP2015/073980.

*Primary Examiner* — Mary Davis
*Assistant Examiner* — Paul W Thiede
(74) *Attorney, Agent, or Firm* — Andre Roland S.A.; Nikolaus Schibli

(57) ABSTRACT

A four-stroke rotary-piston engine has an outer disk, and inner disk, at least one cylinder, at least one piston, at least one piston rod, a fixed gear engaged with a planet gear and a rotary gate valve positioned at a head of the cylinder. The inner disk is rotatable with respect to the outer disk by a compression control device. The planet gear rotates a crank situated on a shaft thereof. The shaft passes upwardly through the inner disk. The crank reciprocates a lever via the piston rod. The lever has an end pivoted on the outer disk so as to push the piston into and out of the cylinder.

3 Claims, 5 Drawing Sheets

(52) U.S. Cl.
CPC ..... *F02B 57/06* (2013.01); *F02B 75/265* (2013.01); *F02B 57/04* (2013.01)

(58) Field of Classification Search
CPC ..... F01C 20/14; F01L 7/026; F02B 57/04; F02B 57/06; F02B 75/265; F02B 75/22; F02B 75/222; F02B 57/08
USPC ..... 418/34, 29, 30, 31
See application file for complete search history.

(56) References Cited

U.S. PATENT DOCUMENTS

| | | | | |
|---|---|---|---|---|
| 1,353,390 | A | 9/1920 | Grotz | |
| 2,071,493 | A * | 2/1937 | Braden | B60K 17/10 192/60 |
| 2,990,820 | A | 7/1961 | Genzo | |
| 4,077,365 | A | 3/1978 | Schlueter | |
| 4,166,438 | A | 9/1979 | Gottschalk | |

FOREIGN PATENT DOCUMENTS

| | | | |
|---|---|---|---|
| EP | 1128035 | A1 | 8/2001 |
| ES | 2072175 | A2 | 1/1995 |
| GB | 831814 | A | 3/1960 |
| WO | 9502114 | A1 | 1/1995 |
| WO | 2005121529 | A2 | 12/2005 |

* cited by examiner

First revolution

1. Stroke: suction

2. Stroke: compression

Second revolution

3. Stroke: working

4. Stroke: exhaustion

FOUR-STROKE ROTARY- PISTON ENGINE WITH ADJUSTABLE COMPRESSION RATIO AND ADJUSTABLE VALVE CONTROL TIMES

CROSS-REFERENCE TO RELATED APPLICATIONS

The present application is a United States national applicaton of International patent application PCT/EP2015/073980 filed on Oct. 16, 2015, which designated the United States, the entire contents of this document being herewith incorporated by reference.

STATEMENT REGARDING FEDERALLY SPONSORED RESEARCH OR DEVELOPMENT

Not applicable.

THE NAMES OF THE PARTIES TO A JOINT RESEARCH AGREEMENT OR DEVELOPMENT

Not applicable.

INCORPORATION-BY-REFERENCE OF MATERIALS SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURE BY THE INVENTOR OR A JOINT INVENTOR

Not applicable.

BACKGROUND OF THE INVENTION

1. Field of the Invention

The present invention relates to four-stroke rotary piston engines.

2. Description of Related Art Including Information Disclosed Under 37 CFR 1.97 and 37 CFR 1.98

BRIEF SUMMARY OF THE INVENTION

A four-stroke combustion engine is disclosed, wherein the piston does not—as usually—move up and down in a fixed cylinder, but the piston and the cylinder both move into one direction. This means that, when the piston reaches the bottom dead center, the cylinder slides downwards over the piston until the piston arrives at the top dead center. Then, the piston moves downwards again until it reaches the bottom dead center. This cycle repeats itself in circles continuously.

An adjustable compressor and an adjustable valve time allow for optimal combustion. Due to a springless rotary gate valve with its maximum feed-through cross-section, the best possible fill is achieved.

Thus, highest performance, minimum pollutants in the exhaust gas and the utilization of various fuels become possible.

DETAILED DESCRIPTION OF THE INVENTION

Figure 1:
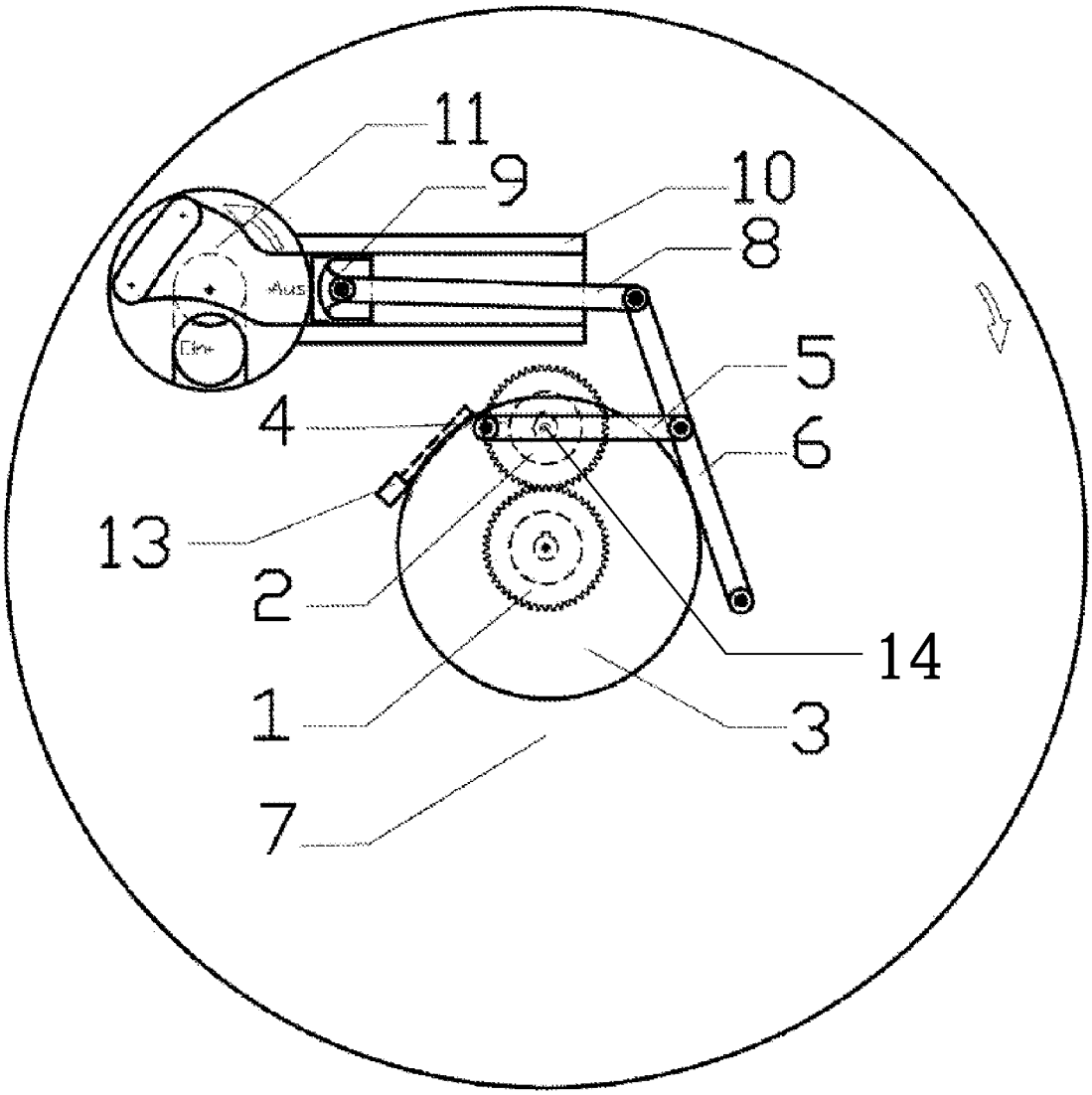
FIG. 1 shows the piston and cylinder moving in one direction.

A planet gear (2) rotates around a fixed gear (1) of the same size. The planet gear (2) is supported on an inner disk (3). This disk is supported at the center of the fixed gear (1). A crank (4), which is as long as the radius of the planet gear (2), moves the lever (6) via the piston rod (5). This lever (6) has one end supported on the outer disk (7). The other end is connected to the piston (9) via the bar (8). The cylinder (10) is affixed to the outer rotary disk (7). Using the compression control device (13), the inner disk (3) is shifted along the outer disk (7). Thereby, the piston rod (5) is pulled or pushed, the position of the lever (5) and the compression ratio are changed. (FIG. 1)

Figure 2:
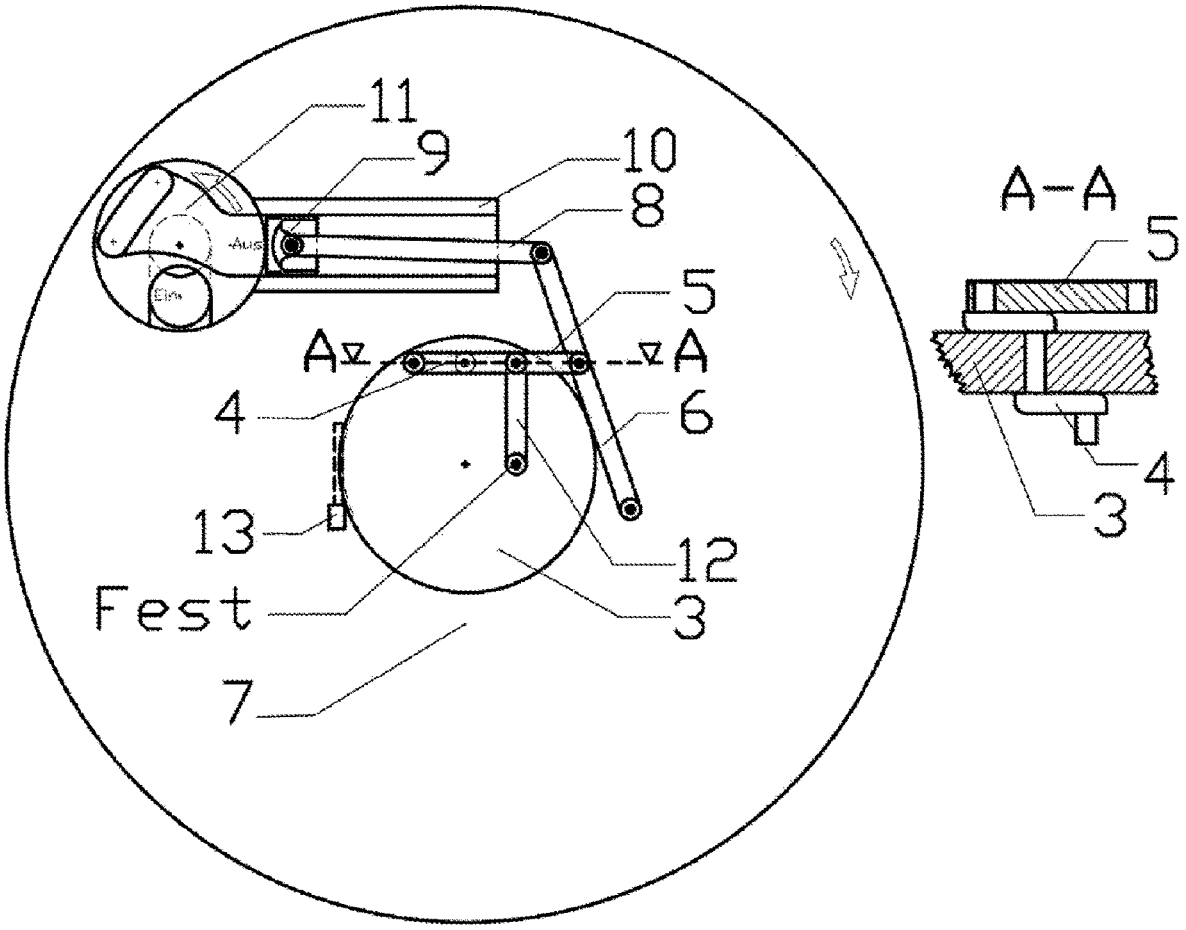
FIG. 2 shows the two gears that moves the piston and cylinder.

For a simple manufacture, instead of two gears, a gear diameter long lower bar (12), where two gears grip together to the housing, and another gear radius long crank (4) can be employed, as shown in FIG. 2, wherein the support of the inner disk (3) is not at the center, but further out (FIG. 2).

The four-stroke rotary-piston engine has an outer disk, and inner disk, at least one cylinder, at least one piston, and at least one piston rod. The outer disk surrounds the inner disk such that the outer disk and the inner disk are in a common plane. The inner disk is rotatable with respect to the outer disk by a compression control device that is adapted to adjust compression. A lower bar is positioned above the outer disk and the inner disk. The lower bar is rotatably mounted to a shaft passing through the inner disk. The shaft has a first crank with a length equal to a radius of one of a pair of gears. The lower bar has a length equal to a diameter of at least one of the pair of gears. A second crank has a length equal to a radius of one of the pair of gears. The second crank is affixed to the shaft which passes through the inner disk and on which the first crank is located. The second crank is rotatably mounted to another end of the lower bar. The lower bar and the second crank move in a non-rotating manner such that when the outer disk and the inner disk are rotated, the first crank rotates so that the piston rod moves the piston via the lever and the lower bar in the same manner as the pair of gears into an out of the cylinder.

A freewheel attached to the outer disk (7) prevents the disk from rotating backwards.

By rotating the disks (3 and 7), the crank (4) is set in rotation, pushes the lever (6) via the piston rod (5), which pulls the piston (9) downwards towards the bottom dead center.

When the piston (9) reaches the bottom dead center, it stands still in relation to the rotary movement, because the crank (4) pulls the piston rod (5) backwards. Yet, the cylinder (10) fastened to the outer disk (7) moves on until the piston (9) reaches the top dead center.

When the piston (9) reaches the top dead center, the crank (4) pushes the piston rod (5) again, and in this way the piston (9) moves downwards until it reaches the bottom dead center.

This procedure is repeated once every revolution. This means that the piston (9) moves from the top to the bottom dead center and back to the top dead center once per revolution.

By repositioning the inner disk (3) in relation to the outer disk (7) using the screw/worm gear (13) of the compression control device, the position of the lever (6) and thus the compression ratio is changed.

Figure 3:
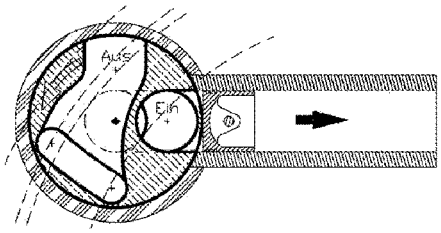
FIG. 3 shows the four positions of the rotary gate valve of the present invention.
Figure 3:
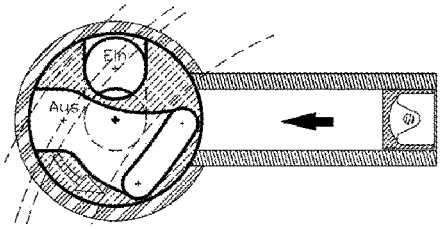
Figure 3:
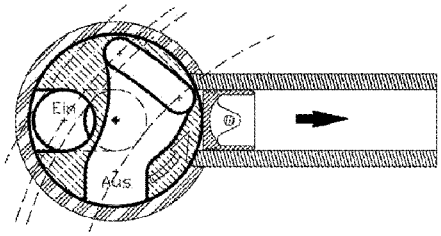
Figure 3:
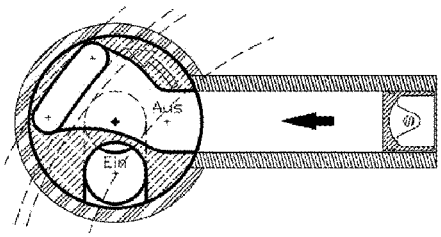

Every half revolution, the rotary gate valve (11) rotates by one quarter revolution (FIG. 3). Thereby, intake and compression are achieved after one full revolution of the disks, and work and emission after the next revolution. In this way, the 4 strokes (FIG. 3) of a combustion engine come about.

The rotary gate valve (FIG. 3) is a cylinder, wherein the gases enter via the intake passage and exit via the exhaust passage (FIG. 6) at the bottom and are communicated into the combustion chamber via pipe ends (FIG. 3), which are attached on the side at the top.

Figure 4:
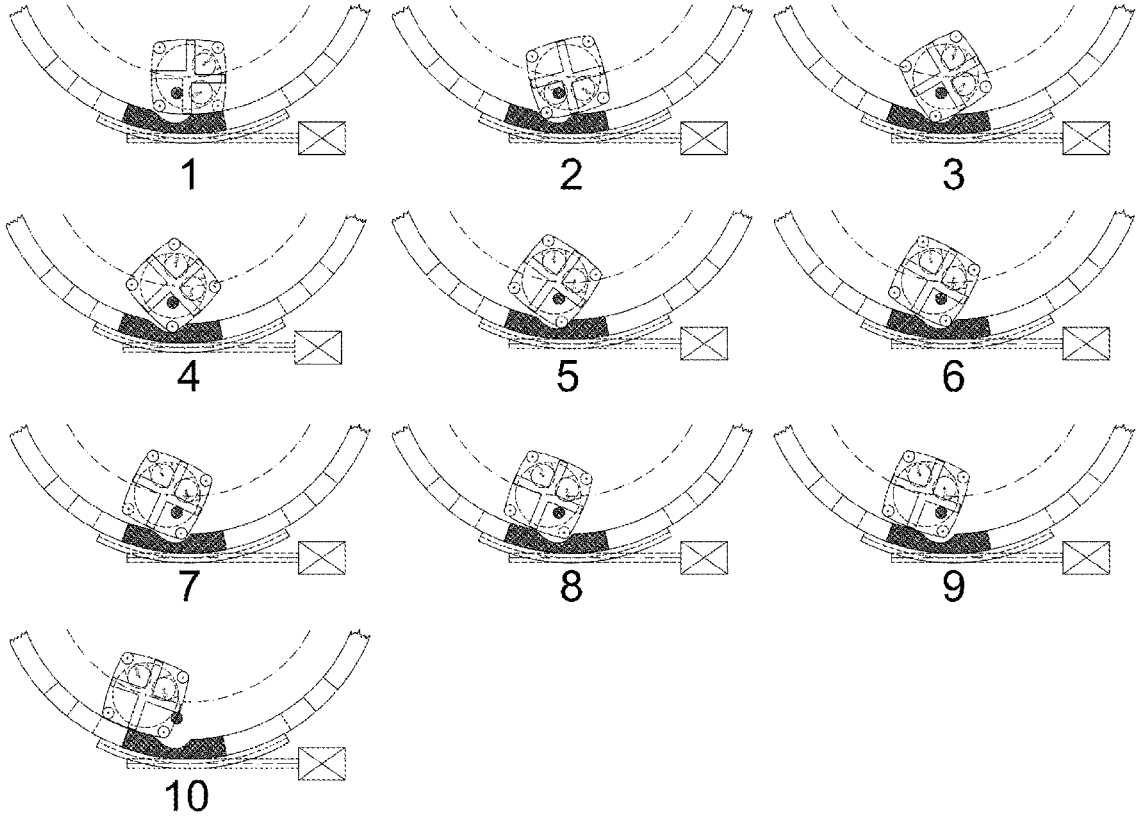
FIG. 4 shows the sequential movement of the quarter rotation device of the present invention.
Figure 5:
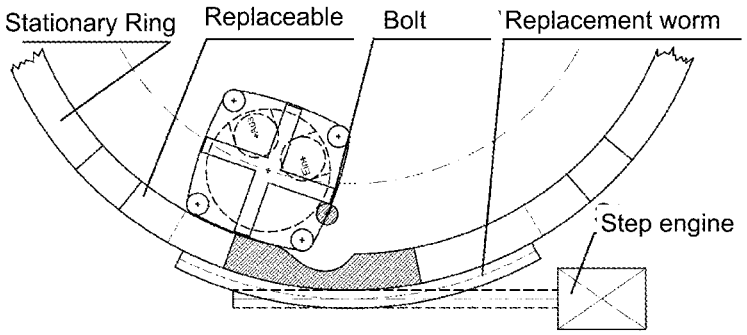
FIG. 5 is a detailed view of the quarter rotation device of the present invention.

The quarter valve rotation device is located on top of the rotary gate valve (11) (FIG. 5). Every full revolution, it hits the two opposing pins attached to the fixed outer ring twice and rotates by one quarter revolution every time (FIG. 4).

In this way, the rotary gate valve revolves twice each full revolution (FIG. 3).

By readjusting the quarter valve rotation device (FIG. 5), the valve opening time is adjusted.

Injection nozzles or spark plugs may be arranged at will. In a similar manner, the combustion chamber may take any form.

Figure 6:
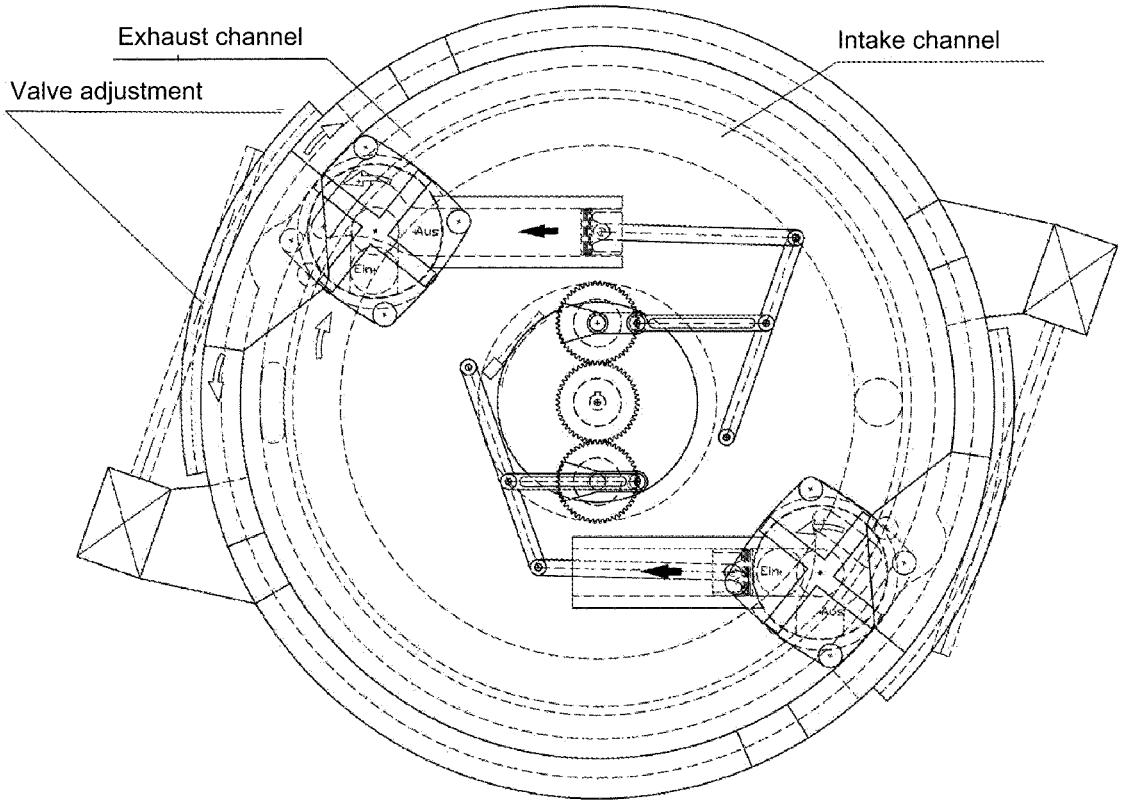
FIG. 6 shows the present invention as used in a two-cylinder engine.

It is possible to have engines with several cylinders, for example a two-cylinder engine as in FIG. 6.

| Names of the parts |
|---|
| 1. fixed gear |
| 2. planet gear |
| 3. inner disk |
| 4. crank |
| 5. piston rod |
| 6. lever |
| 7. outer disk |
| 8. bar |
| 9. piston |
| 10. cylinder |

-continued

| Names of the parts |
|---|
| 11. rotary gate valve |
| 12. lower bar |
| 13. compression control device screw/worm gear |
| 14. shaft |

What is claimed is:

1. A four-stroke rotary-piston engine comprising:

an outer disk;

an inner disk;

at least one cylinder;

at least one piston;

at least one piston rod, said outer disk surrounding said inner disk such that said outer disk and said inner disk are in a common plane, wherein said inner disk is rotatable with respect to said outer disk by a compression control device that is adapted to adjust compression;

a fixed gear engaged with a planet gear, said fixed gear and said planet gear arranged below said outer disk and said inner disk, said planet gear rotating a crank situated on a shaft thereof, the shaft passing upwardly through said inner disk, a length of the crank being equal to a radius of the planet gear, wherein the planet gear is rotatably mounted on said inner disk, wherein the crank reciprocates a lever via said at least one piston rod, the lever having one end pivoted on said outer disk so as to push said at least one piston into and out of said at least one cylinder affixed to said outer disk by a bar pivotally mounted on another end of the lever; and a rotary gate valve positioned at a head of said at least one cylinder.

2. The four-stroke rotary piston engine of claim 1, wherein due to a transmission ratio between said fixed gear and the planet gear and a length of the crank and due to a rotational movement of said inner disk and said outer disk, the crank rotates such that said at least one piston is moved into and out of said at least one cylinder via said at least one piston rod, the lever and the bar, wherein after said at least one piston reaches a bottom dead center position with respect to said at least one cylinder, said at least one cylinder moves further over said at least one piston until said at least one piston reaches a top dead center position, then the crank moves said at least one piston downwardly until reaching the bottom dead center position again.

3. The four-stroke rotary piston engine of claim 1, wherein the four-stroke rotary piston engine is a pump or a compressor.

* * * * *